US005400433A

United States Patent [19]

Davis et al.

[11] Patent Number: 5,400,433

[45] Date of Patent: * Mar. 21, 1995

[54] DECODER FOR VARIABLE-NUMBER OF CHANNEL PRESENTATION OF MULTIDIMENSIONAL SOUND FIELDS

[75] Inventors: Mark F. Davis, Pacifica; Craig C. Todd, Mill Valley, both of Calif.

[73] Assignee: Dolby Laboratories Licensing Corporation, San Francisco, Calif.

[ * ] Notice: The portion of the term of this patent subsequent to Dec. 28, 2010 has been disclaimed.

[21] Appl. No.: 175,051

[22] Filed: Dec. 28, 1993

Related U.S. Application Data

[63] Continuation of Ser. No. 718,356, Jun. 21, 1991, Pat. No. 5,274,740, which is a continuation-in-part of Ser. No. 638,896, Jan. 8, 1991, abandoned.

[51] Int. Cl.[6] ..... G10L 5/00

[52] U.S. Cl. ..... 395/2.29; 395/2.39; 395/2.1; 381/36; 381/37

[58] Field of Search ..... 395/2, 2.1, 2.29, 2.39; 381/22, 29, 36, 37, 41, 43, 51

[56] References Cited

U.S. PATENT DOCUMENTS 5,274,740 12/1993 Davis et al. ..... 395/2.39

*Primary Examiner*—Allen R. MacDonald
*Assistant Examiner*—Tariq Hafiz
*Attorney, Agent, or Firm*—David N. Lathrop; Thomas A. Gallagher

[57] ABSTRACT

The invention relates to the reproduction of high-fidelity multi-dimensional sound fields intended for human hearing. More particularly, the invention relates to the decoding of signals representing such sound fields delivered by one or more delivery channels, but played back over a number of presentation channels which may differ from the number of delivery channels. In one embodiment, a subband decoder combines spectral information in the frequency domain prior to inverse filtering, thereby incurring implementation costs roughly proportional to the number of presentation channels rather than to the number of delivery channels.

10 Claims, 4 Drawing Sheets

DECODER FOR VARIABLE-NUMBER OF CHANNEL PRESENTATION OF MULTIDIMENSIONAL SOUND FIELDS

DESCRIPTION

CROSS-REFERENCE TO RELATED APPLICATIONS

This application is a continuing application of U.S. patent application Ser. No. 07/718,356, filed Jun. 21, 1991, now U.S. Pat. No. 5,274,740, which is a continuation-in-part of U.S. patent application Ser. No. 07/638,896, filed Jan. 8, 1991, now abandoned.

TECHNICAL FIELD

The invention relates in general to the reproducing of high-fidelity multi-dimensional sound fields intended for human hearing. More particularly, the invention relates to the decoding of signals representing such sound fields delivered by one or more delivery channels, wherein the complexity of the decoding is roughly proportional to the number of channels used to present the decoded signal which may differ from the number of delivery channels.

BACKGROUND

A goal for high-fidelity reproduction of recorded or transmitted sounds is the presentation at another time or location as faithful a representation of an "original" sound field as possible given the limitations of the presentation or reproduction system. A sound field is defined as a collection of sound pressures which are a function of time and space. Thus, high-fidelity reproduction attempts to recreate the acoustic pressures which existed in the original sound field in a region about a listener.

Ideally, differences between the original sound field and the reproduced sound field are inaudible, or if not inaudible at least relatively unnoticeable to most listeners. Two general measures of fidelity are "sound quality" and "sound field localization."

Sound quality includes characteristics of reproduction such as frequency range (bandwidth), accuracy of relative amplitude levels throughout the frequency range (timbre), range of sound amplitude level (dynamic range), accuracy of harmonic amplitude and phase (distortion level), and amplitude level and frequency of spurious sounds and artifacts not present in the original sound (noise). Although most aspects of sound quality are susceptible to measurement by instruments, in practical systems characteristics of the human hearing system (psychoacoustic effects) render inaudible or relatively unnoticeable certain measurable deviations from the "original" sounds.

Sound field localization is one measure of spatial fidelity. The preservation of the apparent direction (both azimuth and elevation) and distance of a sound source is sometimes known as angular and depth localization, respectively. In the case of certain orchestral and other recordings, such localization is intended to convey to the listener the actual physical placement of the musicians and their instruments. With respect to other recordings, particularly multiple track recordings produced in a studio, the angular directionality and depth may bear no relationship to any "real-life" arrangement of sound sources and the localization is merely a part of the overall aaistic impression intended to be conveyed to the listener. For example, speech seeming to originate from a specific point in space may be added to a pre-recorded sound field. In any case, one purpose of high-fidelity multi-channel reproduction systems is to reproduce spatial aspects of an on-going sound field, whether real or synthesized. As with respect to sound quality, in practical systems measurable changes in localization are, under certain conditions, inaudible or relatively unnoticeable because of characteristics of human hearing.

It is sufficient to recognize that a sound-field producer may develop recorded or transmitted signals which, in conjunction with a reproduction system, will present to a human listener a sound field possessing specific characteristics in sound quality and sound field localization. The sound field presented to the listener may closely approximate the ideal sound field intended by the producer or it may deviate from it depending on many factors including the reproduction equipment and acoustic reproduction environment.

A sound field captured for transmission or reproduction is usually represented at some point by one or more electrical signals. Such signals usually constitute one or more channels at the point of sound field capture ("capture channels"), at the point of sound field transmission or recording ("transmission channels"), and at the point of sound field presentation ("presentation channels"). Although within some limits as the number of these sound channels increases, the ability to reproduce complex sound fields increases, practical considerations impose limits on the number of such channels.

In most, if not all cases, the sound field producer works in a relatively well defined system in which there are known presentation channel configurations and environments. For example, a two-channel stereophonic recording is generally expected to be presented through either two presentation channels ("stereophonic") or one presentation channel ("monophonic"). The recording is usually optimized to sound good to most listeners having either stereophonic or monophonic playback equipment. As another example, a multiple-channel recording in stereo with surround sound for motion pictures is made with the expectation that motion picture theaters will have either a known, generally standardized arrangement for presenting the left, center, right, bass and surround channels or, alternatively, a classic "Academy" monophonic playback. Such recordings are also made with the expectation that they will be played by home playback equipment ranging from single presentation-channel systems such as a small loudspeaker in a television set to relatively sophisticated multiple presentation-channel surround-sound systems.

Various techniques attempt to reduce the number of transmission channels required to carry signals representing multiple-dimensional sound fields. One example is a 4-2-4 matrix system which combines four channels into two transmission channels for transmission or storage, from which four presentation channels are extracted for playback. Another more sophisticated technique is subband steering which exploits psychoacoustic principles to reduce the number of transmission channels without degrading the subjective quality of the sound field. An encoder/decoder system utilizing subband steering is disclosed in U.S. patent application Ser. No. 07/638,896.

Such techniques may be used without departing from the scope of the present invention, however, it may not always be desirable to do so. The use of these techniques make it necessary to develop the concept of a "delivery channel." A delivery channel represents a discrete encoder channel, or a set of information which is independently encoded. A delivery channel corresponds to a transmission channel in systems which do not use techniques to reduce the number of transmission channels. For example, a 4-2-4 matrix system carries four delivery channels over two transmission channels, ostensibly for playback using four presentation channels. The present invention is directed toward selecting a number of presentation channels which differs from the number of delivery channels.

An example of a simple prior art technique which generates one presentation channel in response to two delivery channels is the summing of the two delivery channels to form one presentation channel. If the signal is sampled and digitally encoded using Pulse Code Modulation (PCM), the summation of the two delivery channels may be performed in the digital domain by adding PCM samples representing each channel and converting the summed samples into an analog signal using a digital-to-analog converter (DAC). The summation of two PCM coded signals may also be performed in the analog domain by converting the PCM samples for each delivery channel into an analog signal using two DACs and summing the two analog signals. Performing the summation in the digital domain is usually preferred because a digital adder is generally more accurate and less expensive to implement than a high-precision DAC.

This technique becomes much more complex, however, if signal samples are digitally encoded in a nonlinear form rather than encoded in linear PCM. Nonlinear forms may be generated by encoding methods such as logarithmic quantizing, normalizing floating-point representations, and adaptively allocating bits to represent each sample.

Nonlinear representations are frequently used in encoder/decoder systems to reduce the amount of information required to represent the coded signal. Such representations may be conveyed by transmission channels with reduced informational capacity, such as lower bandwidth or noisy transmission paths, or by recording media with lower storage capacity.

Nonlinear representations need not reduce informational requirements. Various forms of information packing may be used only to facilitate transmission error detection and correction. The broader terms "formatted" and "formatting" will be used herein, therefore, to refer to nonlinear representations and to obtaining such representations, respectively. The terms "deformatted" and "deformatting" will refer to reconstructed linear representations and to obtaining such reconstructed linear representations, respectively.

It should be mentioned that what constitutes a "linear" representation depends upon the signal processing methods employed. For example, floating-point representation is linear for a Digital Signal Processor (DSP) which can perform arithmetic with floating-point operands, but such representation is not linear for a DSP which can only perform integer arithmetic. The significance of "linear" will be discussed further in connection with the DETAILED DESCRIPTION OF THE INVENTION, below.

A decoder must use deformatting techniques inverse to the formatting techniques used to format the information to obtain a representation like PCM which can be summed as described above.

Two encoding techniques which utilize formatting to reduce informational requirements are subband coding and transform coding. Subband and transform coders attempt to reduce the amount of information transmitted in particular frequency bands where the resulting coding inaccuracy or coding noise is psychoacoustically masked by neighboring spectral components. Psychoacoustic masking effects usually may be more efficiently exploited if the bandwidth of the frequency bands are chosen commensurate with the bandwidths of the human ear's "critical bands." See generally, the *Audio Engineering Handbook*, K. Blair Benson ed., McGraw-Hill, San Francisco, 1988, pages 1.40–1.42 and 4.8–4.10. Throughout the following discussion, the term "subband" shall refer to portions of the useful signal bandwidth, whether implemented by a true subband coder, a transform coder, or other technique. The term "subband coder" shall refer to true subband coders, transform coders, and other coding techniques which operate upon such "subbands."

Signals in a formatted form cannot be summed directly, therefore each of the two delivery channels must be decoded before they can be combined by summation. Generally, decoding techniques such as subband decoding are relatively expensive to implement. Therefore, monophonic presentation of a two-channel signal is approximately twice as costly as monophonic presentation of a one-channel signal. The cost is approximately double because an expensive decoder is needed for each delivery channel.

One prior art technique which avoids burdening the cost of monophonic presentation of two-channel signals is matrixing. It is important to distinguish matrixing used to reduce the number presentation channels from matrixing used to reduce the number of transmission channels. Although they are mathematically similar, each technique is directed to very different aspects of signal transmission and reproduction.

One simple example of matrixing encodes two channels, A and B, into SUM and DIFFERENCE delivery channels according to $$SUM = A + B, \text{ and}$$

$$DIFFERENCE = A - B.$$

For two-channel stereophonic playback, a presentation system can obtain the original two-channel signal by using two decoders to decode each delivery channel and de-matrixing the decoded channels according to $$A' = \tfrac{1}{2} \cdot (SUM + DIFFERENCE), \text{ and}$$

$$B' = \tfrac{1}{2} \cdot (SUM - DIFFERENCE).$$

The notation A' and B' is used to represent the fact that in practical systems, the signals recovered by de-matrixing generally do not exactly correspond to the original matrixed signals.

For monophonic playback, a presentation system can obtain a summation of the original two-channel signal by using only one decoder to decode the SUM delivery channel.

Although matrixing solves the problem of disproportionate cost for monophonic presentation of two delivery channels, it suffers from what may be perceived as cross-channel noise modulation when it is used in conjunction with encoding techniques which reduce the informational requirements of the encoded signal. For example, "companding" may be used for analog signals, and various bit-rate reduction methods may be used for digital signals. The application of such techniques stimulates noise in the output signal of the decoder. The intent and expectation is that this noise is masked by the audio signal which stimulated it, thus making it inaudible. When such techniques are applied to matrixed signals, the de-matrixed signal may be incapable of masking the noise.

Assume that a matrix encoder encodes channels A and B where only channel B contains an audio signal. The SUM and DIFFERENCE signals are coded for transmission with an analog compander or a digital bit-rate reduction technique. During decoding, the A′ presentation channel will be obtained from the sum of the SUM and DIFFERENCE delivery channels. Although the A′ presentation channel will not contain any audio signal, it will contain the sum of the analog modulation noise or the digital coding noise independently injected into each of the SUM and DIFFERENCE delivery channels. The A′ presentation channel will not contain any audio signal to psychoacoustically mask the noise. Furthermore, the noise in channel A′ may not be masked by the audio signal in channel B′ because the ear can usually discern noise and audio signals with different angular localization.

Techniques used to control the number of presentation channels become even more of a problem when more than two delivery channels are involved. For example, motion picture soundtracks typically contain four channels: Left, Center, Right, and Surround. Some current proposals for future motion picture and advanced television applications suggest five channels plus a sixth limited bandwidth subwoofer channel. When multiple-channel signals in a formatted form are delivered to consumers for playback on monophonic and two-channel home equipment, the question arises how to economically obtain a signal suitable for one- and two-channel presentation while avoiding the cross-channel noise modulation effect described above.

SUMMARY OF THE INVENTION

It is an object of the present invention to provide for the decoding of one or more delivery channels of signals encoded to represent in a formatted form a multidimensional sound field without artifacts perceived as cross-channel noise modulation, wherein the complexity or cost of the decoding is roughly proportional to the number of presentation channels. Although a decoder embodying the present invention may be implemented using analog or digital techniques or even a hybrid arrangement of such techniques, the invention is more conveniently implemented using digital techniques and the preferred embodiments disclosed herein are digital implementations.

In accordance with the teachings of the present invention, in one embodiment, a transform decoder receives an encoded signal in a formatted form comprising one or more delivery channels. A deformatted representation is generated for each delivery channel. Each channel of deformatted information is distributed to one or more inverse transforms for output signal synthesis, one inverse transform for each presentation channel.

It should be understood that although the use of subbands with bandwidths commensurate with the human ear's critical bandwidths allows greater exploitation of psychoacoustic effects, application of the teachings of the present invention are not so limited. It will be obvious to those skilled in the art that these teachings may be applied to wideband signals as well, therefore, reference to subbands throughout the remaining discussion should be construed as one or more frequency bands spanning the total useful bandwidth of input signals.

As discussed above, the present invention applies to subband coders implemented by any of several techniques. A preferred implementation uses a transform, more particularly a time-domain to frequency-domain transform according to the Time Domain Aliasing Cancellation (TDAC) technique. See Princen and Bradley, "Analysis/Synthesis Filter Bank Design Based on Time Domain Aliasing Cancellation," *IEEE Trans. on Acoust., Speech, Signal Proc.*, vol. ASSP-34, 1986, pp. 1153–1161. An example of a transform encoder/decoder system utilizing a TDAC transform is provided in U.S. patent application Ser. No. 07/458,894, which is hereby incorporated by reference. The application corresponds to the International Patent Application disclosed in Publication Number WO 90/09022.

The various features of the invention and its preferred embodiments are set forth in greater detail in the following DETAILED DESCRIPTION OF THE INVENTION and in the accompanying drawings.

DETAILED DESCRIPTION OF THE INVENTION

Figure 2:
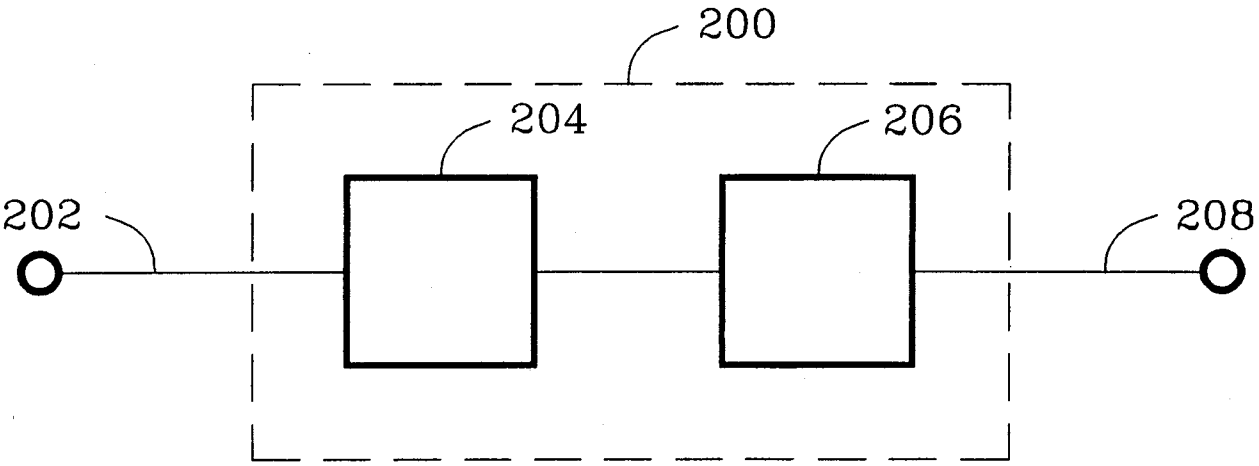
FIG. 2 is a functional block diagram illustrating the basic structure of a single-channel subband decoder.

FIG. 2 illustrates the basic structure of a typical single-channel subband decoder 200. Encoded subband signals received from delivery channel 202 are deformatted into linear form by deformatter 204, and synthesizer 206 generates along presentation channel 208 a full-bandwidth representation of the received signal. It should be appreciated that a practical implementation of a decoder may incorporate additional features such as a buffer for delivery channel 202, and a digital-to-analog converter and a low-pass filter for presentation channel 208, which are not shown.

As briefly mentioned above, deformatter 204 obtains a linear representation using a method inverse to that used by a companion encoder which generated the nonlinear representation. In a practical embodiment, such nonlinear representations are generally used to reduce the informational requirements imposed upon transmission channels and storage media. Deformatting generally involves simple operations which can be performed relatively quickly and are relatively inexpensive to implement.

Synthesizer 206 represents a synthesis filter bank for true digital subband decoders, and represents an inverse transform for digital transform decoders. Signal synthesis for either type of decoder is computationally intensive, requiring many complex operations. Thus, synthesizer 206 typically requires much more time to perform and incurs much higher costs to implement than that required by deformatter 204.

Figure 3:
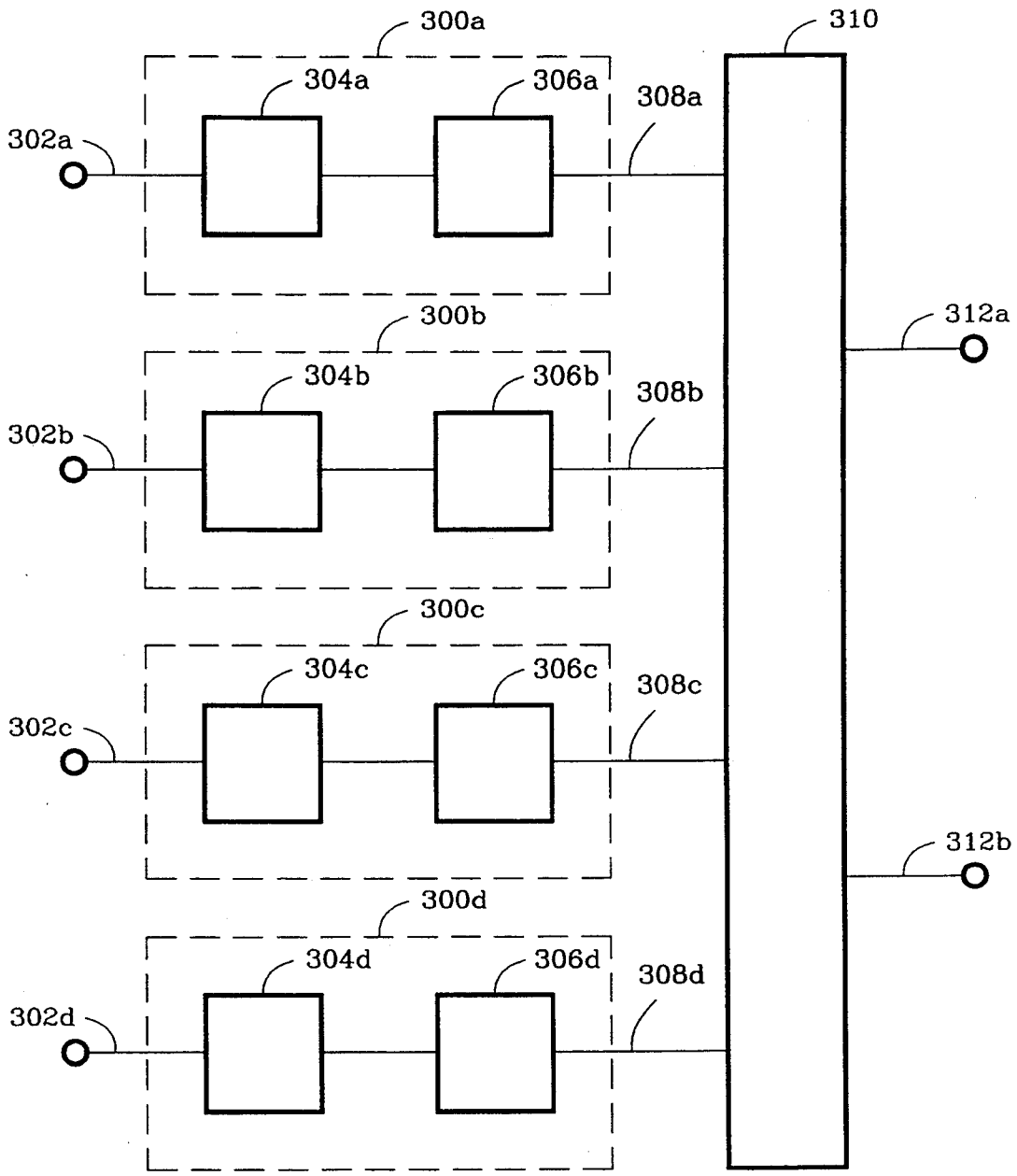
FIG. 3 is a functional block diagram illustrating the basic structure of a prior-art multiple-channel subband decoder distributing four decoded delivery channels into two presentation channels.

FIG. 3 illustrates the basic structure of a typical decoder which receives and decodes four delivery channels for presentation by two presentation channels. The encoded signal received from each of the delivery channels 302 is passed through a respective one of decoders 300, each comprising a deformatter 304 and a synthesizer 306. The synthesized signal is passed from each decoder along a respective one of paths 308 to distributor 310 which combines the four synthesized channels into two presentation channels 312. Distributor 310 generally involves simple operations which can be performed relatively quickly using implementations that are relatively inexpensive to implement.

Most of the cost required to implement the decoder illustrated in FIG. 3 is represented by the synthesizers. The number of synthesizers is equal to the number of delivery channels, thus the cost of implementation is roughly proportional to the number of delivery channels.

Figure 1:
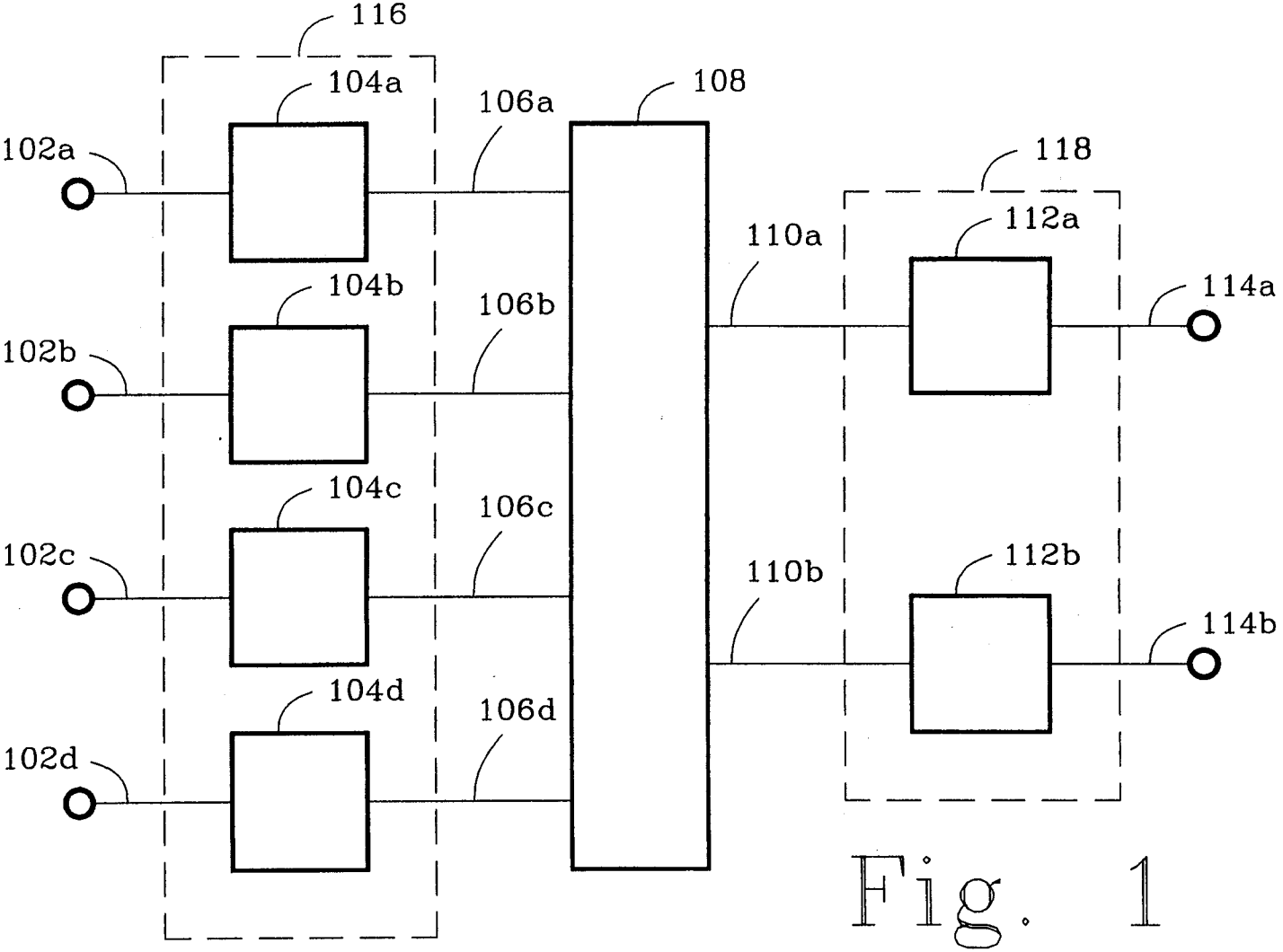
FIG. 1 is a functional block diagram illustrating the basic structure of one embodiment incorporating the invention distributing four delivery channels into two presentation channels.

Signal synthesis is linear if, ignoring small arithmetic round-off errors, signals combined before synthesis will produce the same output signal as that produced by combining signals after synthesis. Synthesis is linear for many implementations of decoders. It is, therefore, possible to interpose a distributor between the deformatters and the synthesizers of such a multiple-channel decoder. Such a structure is illustrated in FIG. 1. In this manner, the cost of implementation is roughly proportional to the number of presentation channels. This is highly desirable in applications such as those proposed for advanced television systems which may receive five delivery channels, but which will provide only one or two presentation channels.

In this context, it is possible to better appreciate the meaning of the term "linear" discussed above. Briefly, any representation is considered linear if it satisfies two criteria: (1) it can be direct input for the synthesizer, and (2) it permits directly forming linear combinations such as addition or subtraction which satisfy the signal synthesis linearity property described above.

FIG. 1 illustrates a decoder according to the present invention which forms two presentation channels from four delivery channels. The decoder receives coded information from four delivery channels 102 which it deformats using deformatters 104, one for each delivery channel. Distributor 108 combines the deformatted signals received from paths 106 into two signals which it passes along paths 110 to synthesizers 112. Each of synthesizers 112 generates a signal which it passes along a respective one of presentation channels 114.

One skilled in the art should readily appreciate that the present invention may be applied to a wide variety of true subband and transform decoder implementations. Details of implementation for deformatters and synthesizers are beyond the scope of this discussion, however, one may obtain details of implementation by referring to any of the U.S. patent applications Ser. Nos. 07/458,894 filed Dec. 29, 1989, 07/508,809 filed Apr. 12, 1990, or 07/638,896 filed Jan. 8, 1991, which are incorporated by reference.

One embodiment of a transform decoder according to the present invention comprises deformatters and synthesizers substantially similar to those described in U.S. patent application Ser. No. 07/458,894. According to this embodiment, referring to FIG. 1, a serial bit stream comprising frequency-domain transform coefficients grouped into subbands is received from each of the delivery channels 102. Each deformatter 104 buffers the bit stream into blocks of information, establishes the number of bits adaptively allocated to each frequency-domain transform coefficient by the encoder of the bit stream, and reconstructs a linear representation for each frequency-domain transform coefficient. Distributor 108 receives the linearized frequency-domain transform coefficients from paths 106, combines them as appropriate, and distributes frequency-domain information among the paths 110. Each synthesizer 112 generates time-domain samples in response to the frequency-domain information received from path 110 by applying an Inverse Fast Fourier Transform which implements the inverse TDAC transform mentioned above. Although no subsequent features are shown in FIG. 1, the time-domain samples are passed along presentation channel 114, buffered and combined to form a time-domain representation of the original coded signal, and subsequently converted from digital form to analog form by a DAC.

Assuming that the four delivery channels 102 in FIG. 1 represent the left (L), center (C), right (R), and surround (S) channels of a four-channel audio system, a typical combination of these channels to form a two-channel stereophonic representation is $$L' = L + 0.7071 \cdot C + 0.5 \cdot S, \text{ and} \quad (1)$$

$$R' = R + 0.7071 \cdot C + 0.5 \cdot S, \quad (2)$$

where L′=left presentation channel, and

R′=right presentation channel.

These combinations represent the summation of transform coefficients in the frequency-domain. It is understood that normally only coefficients representing substantially the same range of spectral frequencies are combined. For example, suppose each delivery channel carries a frequency-domain representation of a 20 kHz bandwidth signal transformed by a 256-point transform. Frequency-domain transform coefficient number zero (X0) for each delivery channel represents the spectral energy of the encoded signal carried by the respective delivery channel centered about 0 Hz, and coefficient one (X1) for each delivery channel represents the spectral energy of the encoded signal for the respective delivery channel centered about 78.1 Hz (20 kHz / 256). Thus, coefficient X1 for the L′ presentation channel is formed from the weighted sum of the X1 coefficients from each delivery channel according to equation 1.

Figure 4:
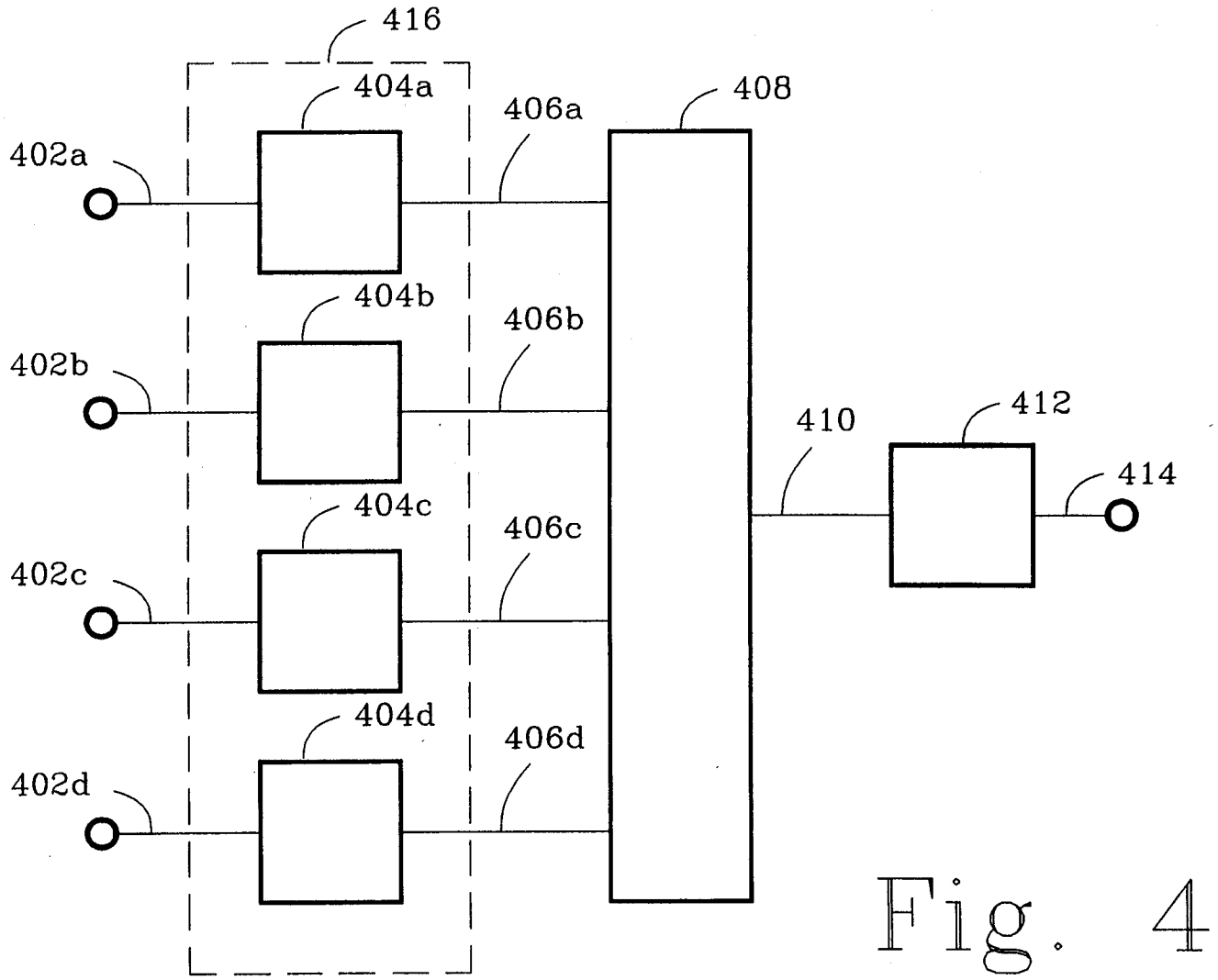
FIG. 4 is a functional block diagram illustrating the basic structure of one embodiment incorporating the invention distributing four delivery channels into one presentation channel.

FIG. 4 represents an application of the present invention used to form one presentation channel from four delivery channels. A typical combinatorial equation for this application is $$M' = 0.7071 \cdot L + C + 0.7071 \cdot R + S \quad (3)$$

where M′=monophonie presentation channel.

The precise forms of the combinations provided by the distributor will vary according to the application.

Although it is envisioned that the present invention will normally be used to obtain a fewer number of presentation channels than there are delivery channels, the invention is not so limited. The number of presentation channels may be the same or greater than the number of delivery channels, utilizing the distributor to prepare presentation channels according to the desired application.

For example, in the transform decoder embodiment described above, two presentation channels might be formed from one delivery channel by distributing specific frequency-domain transform coefficients to a particular presentation channel, or by randomly distributing the coefficients to either or both of the presentation channels. In embodiments using transforms which pass the phase of the spectral components, distribution may be based upon the phase. Many other possibilities will be apparent.

We claim:

1. A decoder comprising:

receiving means for receiving a plurality of delivery channels of formatted subband information, deformatting means responsive to said receiving means for generating a deformatted representation of said subband information in response to each delivery channel, distribution means responsive to said deformatting means for generating one or more intermediate signals, wherein at least one intermediate signal is generated by combining subband information from two or more of said deformatted representations, and synthesis means for generating a respective output signal in response to each of said intermediate signals.

2. A decoder according to claim 1 wherein said combining subband information combines information in one or more respective subbands from said two or more deformatted representations.

3. A decoder comprising:

receiving means for receiving one or more delivery channels of formatted subband information, deformatting means responsive to said receiving means for generating a deformatted representation of said subband information in response to each delivery channel, distribution means responsive to said deformatting means for generating a plurality of intermediate signals, wherein at least two intermediate signals are generated by apportioning subband information from at least one deformatted representation, and synthesis means for generating a respective output signal in response to each of said intermediate signals.

4. A decoder according to claim 3 wherein said apportioning subband information apportions information in one or more respective subbands from said at least one deformatted representation.

5. A decoder according to any one of claims 1 through 4 wherein said synthesis means applies an inverse frequency-domain to time-domain transform to said intermediate signals.

6. A decoder according to any one of claims 1 through 4 wherein said synthesis means applies a true subband synthesis filter bank to said intermediate signals.

7. A decoding method comprising:

receiving a plurality of delivery channels of formatted subband information, generating a deformatted representation of said subband information in response to each delivery channel, generating one or more intermediate signals in response to said deformatted representations, wherein at least one intermediate signal is generated by combining subband information from two or more of said deformatted representations, and generating a respective output signal in response to each of said intermediate signals.

8. A decoding method according to claim 7 wherein said combining subband information combines information in one or more respective subbands from said two or more deformatted representations.

9. A decoding method according to claim 7 or 8 wherein said generating a respective output signal applies an inverse frequency-domain to time-domain transform to said intermediate signals.

10. A decoding method according to claim 7 or 8 wherein said generating a respective output signal applies a true subband synthesis filter bank to said intermediate signals.

* * * * *

UNITED STATES PATENT AND TRADEMARK OFFICE

CERTIFICATE OF CORRECTION

PATENT NO. : 5,400,433
DATED : 3/21/95
INVENTOR(S) : Mark F. Davis, Craig C. Todd It is certified that error appears in the above-indentified patent and that said Letters Patent is hereby corrected as shown below:

Column 1 line 67 of the patent, delete "aaistic" and replace with --artistic--.

Signed and Sealed this

Ninth Day of September, 1997

*Attest:*

Bruce Lehman

BRUCE LEHMAN

*Attesting Officer*

*Commissioner of Patents and Trademarks*